US008637791B2

(12) United States Patent
Goldsmith et al.

(10) Patent No.: US 8,637,791 B2
(45) Date of Patent: Jan. 28, 2014

(54) THERMAL INSULATION ENERGY SAVER DEVICE

(76) Inventors: James B. Goldsmith, New Orleans, LA (US); John Douglas Tolmer, C/L 'Olivera (ES)

( * ) Notice: Subject to any disclaimer, the term of this patent is extended or adjusted under 35 U.S.C. 154(b) by 350 days.

(21) Appl. No.: 12/408,892

(22) Filed: Mar. 23, 2009

(65) Prior Publication Data

US 2010/0237056 A1 Sep. 23, 2010

(51) Int. Cl.
*H05B 1/00* (2006.01)

(52) U.S. Cl.
USPC ..... 219/213; 237/70

(58) Field of Classification Search
USPC ..... 219/213, 604, 618, 643, 644, 649, 200, 219/208, 242, 455.12, 523; 237/70, 71, 237/78 R, 12.6, 30, 33, 43, 45; 165/45, 47, 165/48, 53, 64, 169, 173, 177
See application file for complete search history.

(56) References Cited

U.S. PATENT DOCUMENTS

| | | | | |
|---|---|---|---|---|
| 2,060,088 | A * | 11/1936 | Lane | 237/79 |
| 3,551,642 | A * | 12/1970 | Knoll | 392/353 |
| 3,676,641 | A * | 7/1972 | Olson | 219/200 |
| 4,204,106 | A * | 5/1980 | Colten | 219/213 |
| 2002/0066483 | A1 * | 6/2002 | Sweeney et al. | 137/377 |
| 2006/0237553 | A1 * | 10/2006 | Brown et al. | 237/70 |

FOREIGN PATENT DOCUMENTS

JP 11304289 A * 11/1999 ..... F25B 33/00

OTHER PUBLICATIONS

Novitherm Canada Inc., Energy Convervation for Hot Water Heating System, Dec. 4, 2004.*

* cited by examiner

*Primary Examiner* — Henry Yuen
*Assistant Examiner* — Phuong Nguyen

(57) ABSTRACT

A heating system for heating an interior room may include a radiator member for generating heat, a wall member being positioned in a space relationship to the radiator member and a device member being positioned between the radiator member and the wall member. The device member will have two inner radiant barriers of silver aluminized material protected by paint or lamination. The device member may include an attachment member to attach the device member to the wall member, and the device member may include an inclined surface. The device member may include a horizontal surface, and the device member may include an inclined surface and a horizontal surface. The inclined surface may extend to an edge of the horizontal surface, and the device member may include a substantially flat back surface. The attachment member may be a layer of adhesive, and the attachment member may cover the perimeter of the back surface of the device member. The attachment member may only cover a portion of the back surface of the panel member. The device member may encapsulate air for insulation.

6 Claims, 5 Drawing Sheets

THERMAL INSULATION ENERGY SAVER DEVICE

FIELD OF THE INVENTION

The present invention relates to a double reflector, multiple air-encapsulated or multiple trapped air space thermal insulation energy saver devices and more particularly relates to an attachable device that reduces heat transfer and can be retrofitted to existing heating systems.

BACKGROUND OF THE INVENTION

Heat is transferred from one material to another by conduction, convection and radiation. In home insulation, the R Value is an indication of how well a material insulates.

Hydronic Heating uses hot water to provide whole or a portion of home heating. Water is heated in a boiler and then pumped through piping to panel radiators in each room. Heat is transferred directly from the radiators to the air. Every building using central heating radiators wastes heat, principally through heat loss through walls directly behind a heat emitter (radiator). To cover this waste of heat, additional fuel is burnt needlessly, wasting for the average house approximately 4 to 6 tons of Carbon Dioxide (C02) into the atmosphere every year, significantly contributing to global warming.

Radiators work by heating air that flows past them. Warm air rises from the radiators and colder air in the room falls. This circulation develops a flow of air around the room sending warm air from the radiator and delivering cool air back to the radiator to be heated. Therefore, for radiators to work well, there should be adequate clearance around them so airflow isn't restricted by the position of the radiator. This is why radiators are mounted off the wall a little and above the floor. As it is said "Radiators don't radiate".

A home's performance is rated in terms of the energy use per square meter of the floor area, energy efficiency based on fuel costs and environmental impact based on Carbon Dioxide (C02) emissions. The energy efficient rating is a measure of the overall efficiency of a home. The higher the rating the more energy efficient the home is and the lower the fuel bills will be. The environmental impact rating is a measure of a home's impact on the environment in terms of Carbon Dioxide (C02) emissions. The higher the rating the less impact it has on the environment.

While it is possible to weigh a quantity of gas, by comparing the weight of an evacuated container compared to one filled at a known pressure, climate scientists do not rely on direct measurements. Instead, they use estimates based on the molecular weight of Carbon Dioxide; the weights of other greenhouse gases are converted to their greenhouse impact as compared with that of a ton of Carbon Dioxide.

Carbon Dioxide, the benchmark greenhouse gas implicated in global warming, has a molecule containing one Carbon atom and two Oxygen atoms. The C02 output from burning a quantity of coal or oil is known. Depending on the fuel, the Carbon Dioxide can weigh almost three times as much as the fuel, because of the addition of oxygen from the air.

SUMMARY

A heating system for heating an interior room may include a radiator member for generating heat, a wall member being positioned in a space relationship to the radiator member and a device member being positioned between the radiator member and the wall member.

The device member may include an attachment member to attach the device member to the wall member and the device member may include a first channel and a second channel internal to the device member.

The device member may include an inclined surface and the device member may include a horizontal surface.

The inclined surface may extend to the edge of the horizontal surface and the device member may include a substantially flat back surface.

The attachment member may be a layer of adhesive, and the attachment member may cover the perimeter of each back surface of the panel member.

The attachment member may only cover a portion of the back surface of the panel member, and the panel member may encapsulate air for insulation. The device member may reflect the radiant energy back towards the heat source, and the member device may include a first radiant barrier which will reflect most of the heat energy back to the heat source and a second radiant barrier which will reflect the heat energy that is absorbed through the first radiant barrier back to the heat source.

The member device may be a moisture barrier.

DESCRIPTION OF DRAWINGS

The invention may be understood by reference to the following description taken in conjunction with the accompanying drawings, in which, like reference numerals identify like elements, and in which.

DETAILED DESCRIPTION

Figure 1:
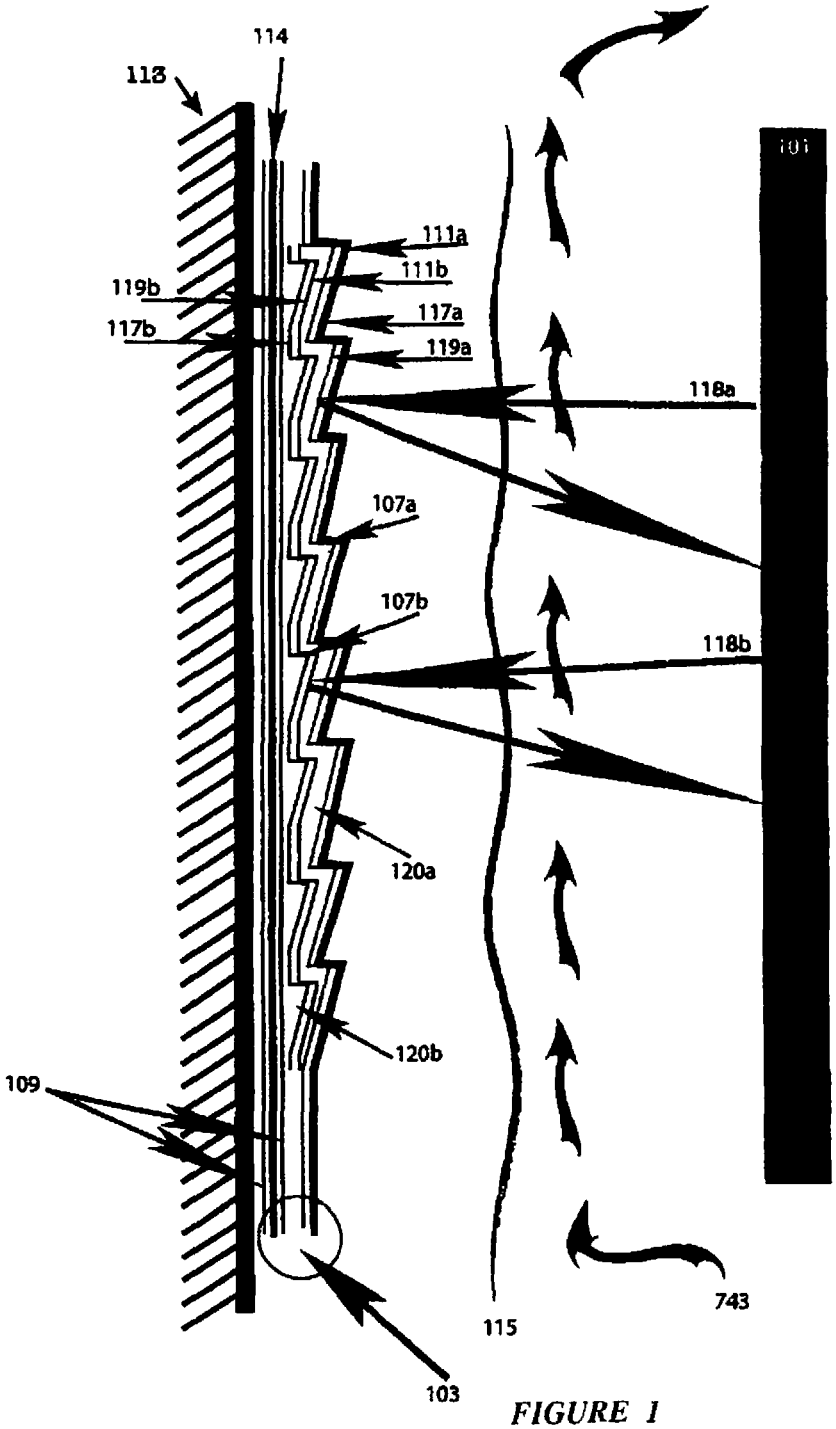
FIG. 1 illustrates a side view of the heating system of the present invention.

The device of the present invention reduces wasted heat by reflection reducing radiative heat transfer. Furthermore, the present device reduces wasted heat by painting or by lamination a double reflective surface of the panel member so that any film of dirt or moisture will not alter the emissivity and hence the performance of the radiant barriers. The present invention allows the radiant barriers painted or laminated to face an open air space to gain maximum performance. Heat rays do not recognize the protective painting or lamination on the two separate reflective surfaces. The present device advantageously employs restricted air spaces that reduce conductive heat transfer by reducing physical contact between objects. Air always contains some moisture; any air movement carries moisture with it. As heat travels from a hot space to a cold space, even if it has to go through a wall, water vapor will travel from a space with a high moisture concentration to a space with a lower moisture concentration, again, even if it has to go through a wall. If moisture forms within the insulation, the insulation will not insulate as well as it should and the heating bills will increase. The device member is a moisture barrier.

The present device reduces convective heat transfer due to a series of vortices in the small valleys forcing the warm airflow away from the surface of the device creating a fluid limit layer between the device and the radiator. This reduced airspace between the radiator and the device increases the airflow speed between the fluid limit layer and the radiator into the room. This fluid limit layer extending for a predetermined distance which may be 2 to 3 meters above the radiator and out into the room in an approximate figure of eight pattern prevents heat dissipation through the wall and any window above, also improving the comfort level in the room, and at the same time eliminating deterioration behind the radiator and discoloration above. The front of the device stays cool to the touch and the radiator now heats the air in the room as opposed to compensating for heat loss through the external or party wall directly behind the radiator. The device stops heat loss through the external or party wall behind a radiator, and the water returns hotter to the boiler. The device member includes a painted or laminated outer profiled material front and a flat back membrane or thin outer covering material protecting two inner silver aluminized radiant barriers that near maximizes the albedo reflecting the radiant energy back towards the heat source. With air condition ducting and forced air ducting, the device reduces convective heat transfer on all sides or circumference of ducting lifting and elevating the airflow away from the surface of the invention device creating a limit layer of stagnant air between the invention device and the forced airflow. The profile of the device may be lengthened or shortened and shaped to accommodate stronger air flows in non-continuous sections.

The device has a shaped surface in the front and a substantially flat surface in the back. The device may be formed from plastics, metal or other suitable material.

The device traps any air, which may penetrate the interior of the device and manages humidity (water vapor) on the wall side of the radiator. The device member acts as a moisture barrier. The back flat surface of the device is easily affixed to the cold external or party wall. The thermal insulation achieved by the device modifies the convective, conductive and radiative heat transfer between wall and radiator, so as to significantly reduce losses to the wall by up to 30% resulting in a reduction of C02 emissions by 4-6 tonnes per average home per year.

With a night time set back of radiator temperature, additional significant heat losses occur from the dynamic effects of heating and cooling the building, especially in evaporating the water from outside walls during the day, to be replaced by cold water condensing during the night. One effect of the device is to thermally isolate the wall behind the radiator from the radiator itself, by means of encapsulated air within the profiled thermal insulation device employing two reflective surfaces protected by a layer of paint or lamination. This is just where the temperature range is greatest, further producing substantial savings in the transient component of heat loss.

With the installation of the device in conjunction with the radiator, the water in the central heating system will be sent back to the boiler at a higher temperature and will therefore require less energy to bring it back to the level needed to heat the house. The savings in fuel use and carbon dioxide (C02) emissions are important.

The device includes a front surface of painted or laminated material protecting an inner surface coating of silver aluminized material. The material having horizontal ridges, such that a cross-section approximates a right triangular shape, with teeth facing upwards. The tooth pitch may be approximately 29 mm long, and the panel traps a layer of air between the front reflective surface and the rear reflective surface (the painted or lamination surface protecting the profiled right triangular rear reflective surface is covered by a membrane which is fixed to the wall) and the distance between the front surface and the rear surface varies linearly from about 2 mm at the bottom of a tooth to about 7 mm at the top.

The device is affixed to the wall in order to maintain a space relationship between the device and the radiator. The device and the radiator may be off-white or other suitable color. The panel is affixed to the wall surface using elastic adhesive that simplifies installation making for a quick and clean process.

The device is designed to eliminate heat loss through the wall that it is fixed to and at the same time improve the comfort level in a room.

The present device is energy efficient, thus saving the owner money.

The present device provides more uniform temperatures throughout the space. There is less temperature gradient both vertically and horizontally from exterior walls, ceilings and windows, thus producing more comfortable occupant environment when outside temperatures are extremely cold.

The present device may have no recurring expense. Unlike heating equipment, the device is permanent and will not require maintenance, upkeep, or adjustment. The present invention will produce greenhouse gas savings year on year.

FIG. 1 illustrates a heating system 100 of the present invention. The heating system 100 may include a radiator member 101 which may be a hot-water radiator in which hot-water passes through the radiator member 101 and warms the fluid which may be air around the radiator member 101. The heating system 100 additionally includes a device member 103, which is affixed to a wall member 113 in order to maintain a fixed space relationship with the radiator member 101. The device member 103 may include an attachment member 109 which may be retrofitted to the existing wall member 113 and may cooperate with the radiator member 101 to create any upward fluid flow 115, for example airflow. The back surface 114 of the panel member 103 is substantially vertical and parallel to the surface of the wall member 113. The front protective profiled surface material 117*a* of the panel member 103 includes multiple horizontal surfaces 107*a* that are formed in a substantially periodic nature and between the horizontal surfaces 107*a* are an inclined surface 111*a*, which extends outwards to the edge of the horizontal surface 107*a*. The back surface 114 has elastic adhesive strips 109 extending to all four sides of the panel that may be for attachment to the wall member 113. The attachment member 109 may be permanently attached to the wall member 113 or may be detachably connected to the wall member 113. The attachment member 109 may be a layer of adhesive, Velcro, double-sided tape or any other appropriate attachment device. The attachment member 109 may be covered with a detachably connected sheet to prevent contamination of the adhesive before it is used to attach to the wall member 113. FIG. 1 additionally illustrates the substantially vertical airflow 115 which may be generated by the heat from the radiator member 101. Substantially, the air does not penetrate the panel member 103. When installed, the panel member 103 may encapsulate a volume of fluid such as air in order to provide additional insulation between the wall 113 and the airflow 115. Air is a good insulator and consequently is a poor conductor. Air works well as an insulator when it is encapsulated within two silver aluminized surfaces painted or laminated with material to protect the two inner reflective surfaces from dust and grime.

FIG. 1 illustrates a heating system 100 of the present invention. The Heating system 100 may include a radiator member

101 which may be a Hot-water radiator in which hot-water passes through the radiator member 101 and warms the fluid which may be air around the radiator.

FIG. 1 illustrates a side view of a "flat panel radiator" heating system 100 of the present invention with the device member 103 detached; the device member may modify the convective, conductive and radiative heat transfer between wall 113 and radiator 101, so as to reduce losses to the wall. The loss reduction may be significant. The outer female panel member 117*a* may be a thin, substantially rigid, plastic sheet or other appropriate material, the inner male insert panel 117*b* may be a similar material to the outer female panel 117*a* and both the outer female panel member 117*a* and the inner male insert panel 117*b* may be formed into substantially horizontal ridges 107*a*, 107*b* or shoulders at sides 117*a* & 119*b*, such that a vertical section through both have a substantially right triangular shape, with the teeth facing upward. The front side female outer panel tooth pitch may be approximately 29 mm long 111*a* or other appropriate length, and the inner male panel tooth pitch may be is approximately 24 mm long 111*b* or other appropriate length and the device member 103 may encapsulate two separate layers of air in a first channel 120*a* which may be defined by the two inner reflective surfaces of the male panel profiled reflective surface 119*b*, and a second channel 120*b* defined by the outer surface of the outer female panel member 117*a*, arrows 118*b* representing heat energy being reflected back towards the heat source from the rear profiled radiant barrier 118*b*, arrows 118*a* may represent heat energy being reflected back to the heat source from the front profiled radiant barrier, painting or laminating material that protects the front reflecting surface from dust and grime. Multiple layers of encapsulated air may be trapped between the membrane or outer covering material 114 and the male profiled member 117*b*. The flow in the trapped air within the first channel 120*a* between the reflective surfaces 119*a* & 119*b* and the trapped air in the second channel 120*b* between the membrane or thin outer covering material 114 and the inner male insert panel 117*b* may be driven by transverse heat conduction through the device member 103. It will carry whatever heat is lost convectively to the wall behind the radiator 101. The flow in the rest of the room may determine the input conditions at the bottom of the channel between the radiator and the device. The encapsulated air first channel 120*a* varies linearly from about 2 mm at the bottom of a tooth to about 7 mm at the top 107*a* and the multiple trapped air spaces 120*b* between the membrane or thin outer covering material 114 and the inner male insert panel 117*b* varies linearly from about 1 mm at the bottom of a tooth to about 2 mm at the top 107*b*. Other dimensions are within the scope of the invention. Radiative heat fluxes are so much greater than convective that two reflective surfaces may be employed. Both reflective surfaces may be completely covered by an outer layer of laminated or painted material that substantially protect the reflective face of each surface front and back from external dust and grime deposits building up on the two separate reflective surfaces, allowing heat rays to be reflected back towards the heat source substantially unimpeded by dust and grime. Radiation may be a major contributor to heat transfer and the two protected reflective surfaces cooperatively function to counter the radiative heat loss. The color of the outer female panel member 117*a* may blend in with the radiator color. The device member 103 may modify the conductive, convective and radiative heat transfer between wall member 113 and heat emitting radiator member 101, so as to significantly reduce losses to the wall 113 behind and above the radiator 101. The effective thermal isolation of the device member 103 from the external or party wall 113, is due to the enclosed air space between the first channel 120*a* and multiple air spaces of the second channel 120*b*. The two profiled reflective barriers of the outer female profiled female reflective surface 119*a* and the inner male profiled reflective surface 119*b* may increase the albedo (reflectivity). The transmitivity may be lower further improving the energy savings. The airflow moving upwards over the right triangular shaped profile has the effect of creating vortices in the horizontal valleys resulting in stagnant air 115 that then holds the hot air flow 743 away from the front outer profiled surface 117*a* of the device member 103, keeping it substantially cool to the touch even with close proximity of a very hot heat emitting radiator surface of the radiator 101. The vortices in the horizontal valleys form a fluid limiting layer of stagnant air 115 reducing the gap between radiator 101 and the fluid limiting layer effectively reducing the airflow space between the radiator 101 and the device member 103 greatly strengthening the hot upward airflow 743 thus bringing a more desirable flow pattern leading to larger convective savings and meeting and heating the downward flow of cold air above the radiator and carrying the hot airflow 743 thermodynamically from behind the radiator 101 into the room in substantially a figure of eight pattern returning from the far wall to the corner under the radiator 101 giving a powerful upward flow 743 into the gap between radiator and the device member 103. With a night-time setback of radiator temperature, additional significant heat losses may occur from the dynamic effects of heating and cooling the building, especially in evaporating water from outside walls during the day, to be replaced by cold water condensing during the night. One effect of the device member 103 is to thermally isolate the wall behind the radiator from the radiator itself by the separate encapsulated first and second channels 120*a* & 120*b* within the device member 103. Air is a good insulator and consequently is a poor conductor. The back reflective surface 119*b* covered by the protective material of the inner male insert panel 117*b* further eliminates any heat loss that may reach the back reflective surface of the male panel profile reflector surface 119*b* of the device member 103. This is just where the temperature range is greatest without the device member (103), so that a substantial saving could also be expected in the transient component of heat loss.

Figure 2:
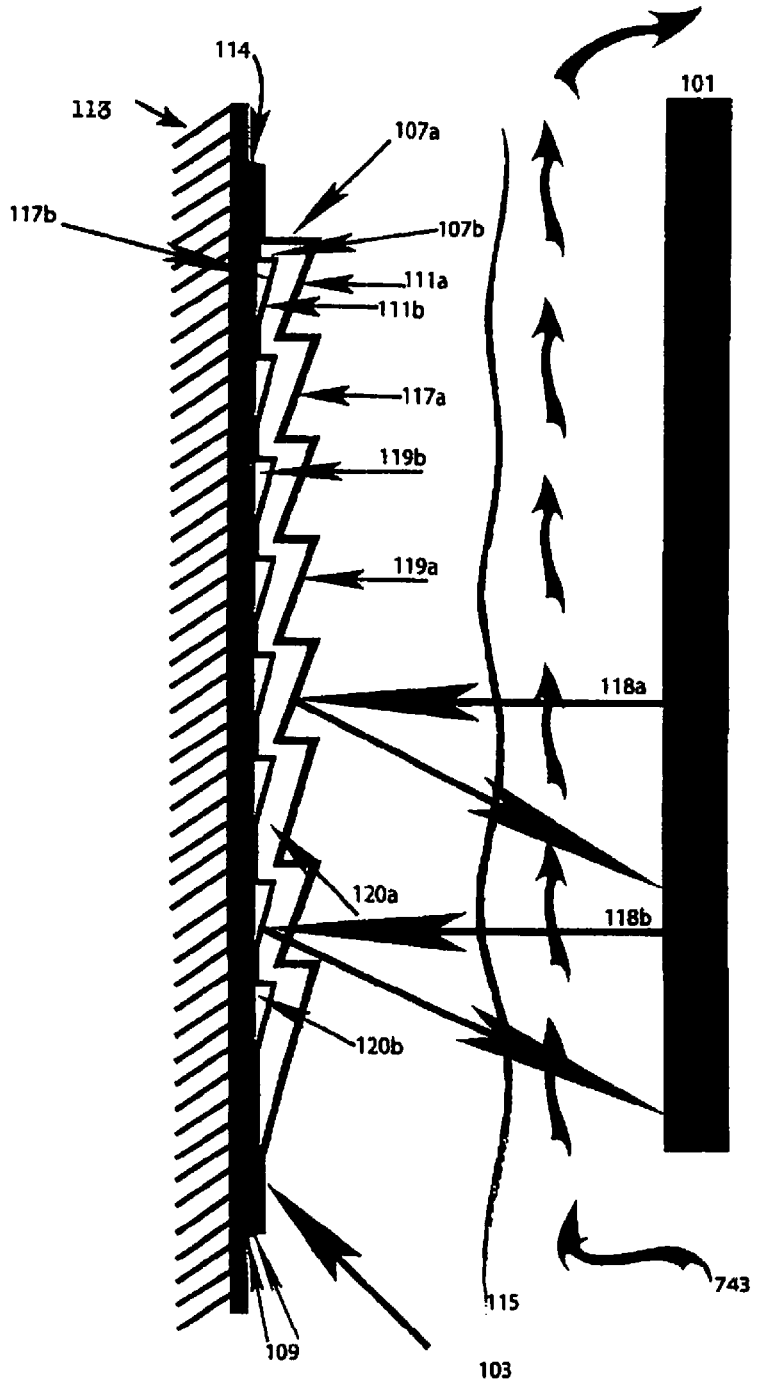
FIG. 2 illustrates another side view of the heating system of the present invention.

FIG. 2 illustrates a heating system 100 of the present invention. The heating system 100 may include a radiator member 101 which may be a hot-water radiator in which hot-water passes through the radiator member 101 and warms the fluid which may be air around the radiator member 101. The heating system 100 additionally includes a device member 103 which may be affixed to a wall member 113 in order to maintain a fixed spaced relationship between the device member 103 and the radiator member 101. FIG. 2 illustrates that the attachment member 109 may be positioned on the wall member 113 to cooperate with the radiator member 101. The attachment member 109 facilitates the installation between the wall member 113 and the radiator member 101. The back surface of the attachment member 109 covers the perimeter of each panel. The front outer surface material 117*a* laminated or painted over the silver aluminized inner material 119*a* of the panel member 103 includes multiple horizontal surfaces 107*a* which are formed in the periodic nature and between the horizontal surfaces 107*a* are an inclined surface 111*a* which extends outwards to the horizontal surface 107*a*. The outer back surface 114 includes an attachment surface 109, which is elastic adhesive for attachment to the wall member 113. FIG. 2 additionally illustrates the substantially vertical airflow 115, which is generated by the heat from the radiator member 101. Substantially, the air does not penetrate the panel member 103.

FIG. 2 illustrates another side view of a heating system with the device member (103) attached to the wall member (113). The attachment member 109 is a device which may include elastic adhesive strips, Velcro, or another suitable adhesive material and may be positioned on the wall member 113 to cooperate with the device member 103. The attachment member 109 facilitates the installation of the panel member 103. The attachment 109 may include a removable protective surface (not indicated by number) that is designed to avoid contamination to the installation device, and is designed for easy removal before installation.

Figure 3:
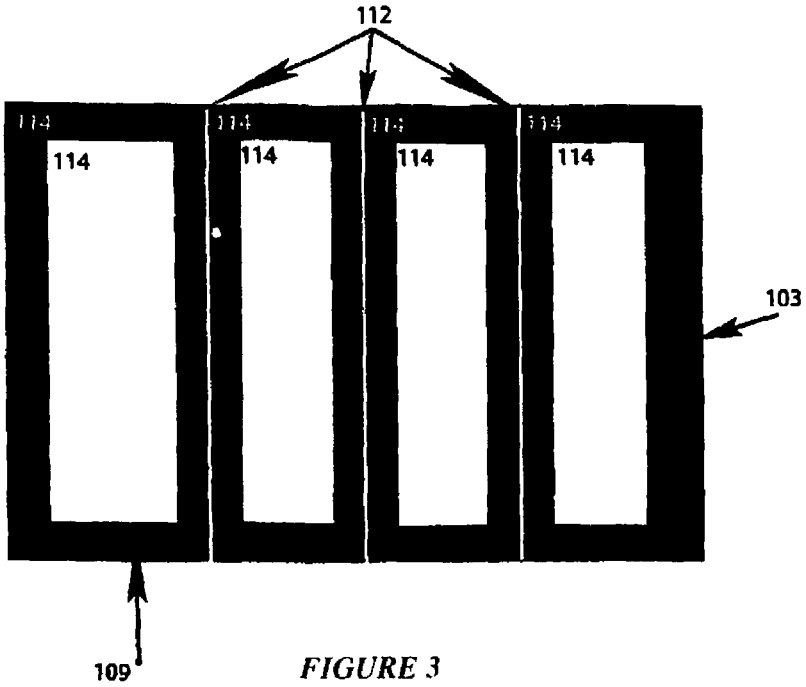
FIG. 3 illustrates a back view of the protective cover of the present invention.

FIG. 3 illustrates on the back surface 114, the attachment member 109 which may be connected to the device member 103.

FIG. 3 illustrates a back view of the invention device member 114 of the present invention device member 103 with adhesive strip or otherwise suitable adhering materials 109 that make installation a simpler process of pulling off the protective cover (not indicated by number) around the four sides of each panel exposing the adhesive and then pressing the device onto the wall area 113. The protective cover may be applied so as to avoid contamination to the back surface adhering material. The cut lines 112 may be printed on the membrane 114 for panel separation.

Figure 4:
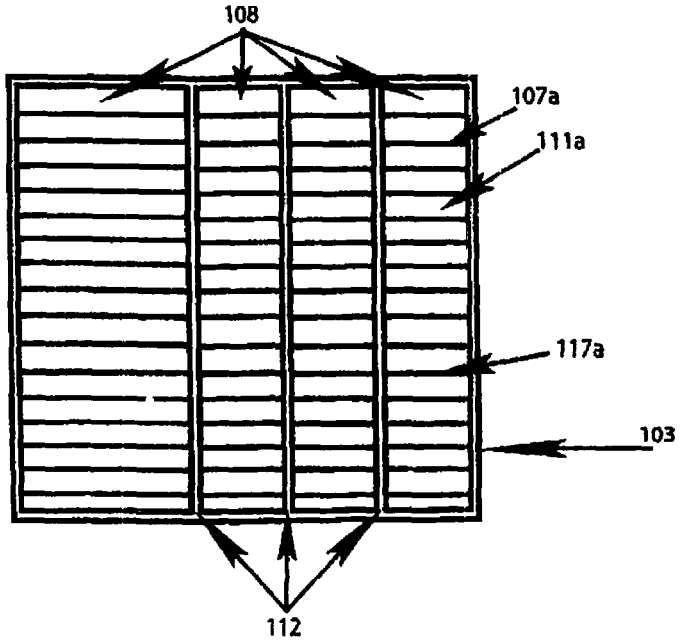
FIG. 4 illustrates a front view of the device member of the present invention.

FIG. 4 illustrates the front surface 117*a*, of the device member 103 and shows the inclined surfaces 111*a* and the horizontal surfaces 107*a*, with four panel sections 108, with three cut to fit spaces 112, for ease of installation.

FIG. 4 illustrates a front view of the outer female panel member 117*a* of the device member 103. The device member 103 may include four panels which may be in varying widths and may include cut lines to facilitate sizing for a particular installation and to accommodate most sizes of radiators. The device member (103) with four separate panels (108) and three cut lines (112) for simple installation on the outside of wall brackets or in between the wall brackets. This modular format of pre-applied adhesive to the device member may make for a new and time saving method of retro fitting the device and panel members for unskilled workers, male or female.

Figure 5:
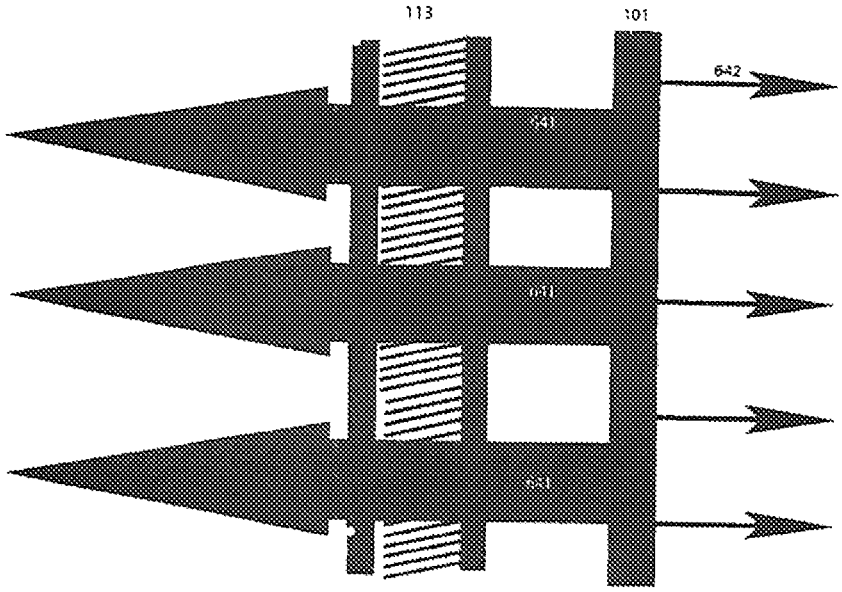
FIG. 5 illustrates the heat loss through a wall.

FIG. 5 illustrates the airflow 641 generated by the radiator member 101 without the panel member 103 and FIG. 5 illustrates that the airflow 641 is substantially horizontal and flows substantially unimpeded to the wall member 113, reducing airflow to the room 642.

FIG. 5 illustrates the heat loss 641 through the external or party wall area 113 behind a heat-emitting radiator 101 without the installation of the device member 103. Before a radiator is able to heat the air in a room 642, it first must heat the air up to one meter outside the external or party wall and the wall fabric of the building directly behind the radiator and maintain this loss before it can heat up the air in the room.

Figure 6:
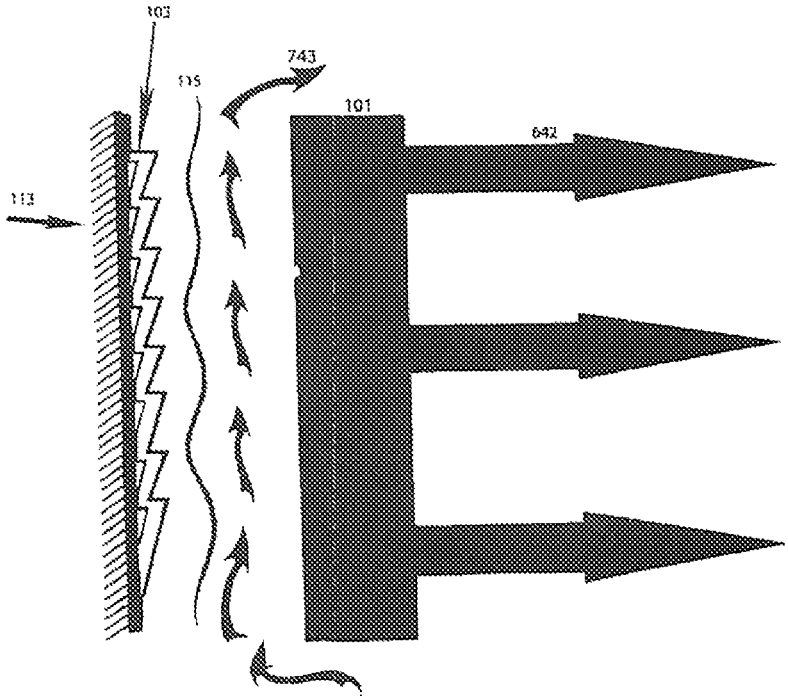
FIG. 6 illustrates a reduction in the heat loss.

In contrast, FIG. 6 illustrates the airflow 743, which flows between the device member 103 and the radiator member 101 in a substantially vertical and rising direction. The device member 103 directs the airflow 743 to avoid the wall member 113, stronger airflow into the room 642.

FIG. 6 illustrates the reduction of heat loss and airflow associated with the device member 103 and the radiator member 101 the limiting layer of stagnant air 115 the hot airflow 743 the radiator 101 and the strengthened heat flux into the room 642 of the device member 103.

Figure 7:
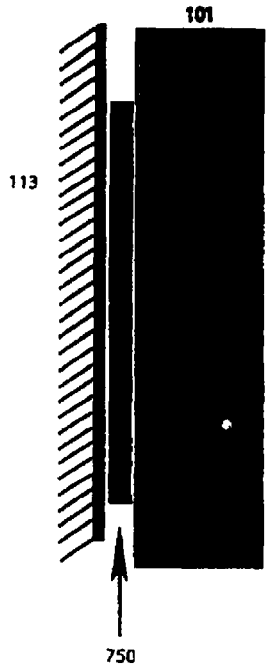
FIG. 7 illustrates wall brackets holding the radiator to the wall.

FIG. 7 illustrates a radiator 101, fixed to a wall 113, with brackets 750.

FIG. 7 shows wall brackets 750 holding the radiator 101 to the wall 113 without the device member 103.

Figure 8:
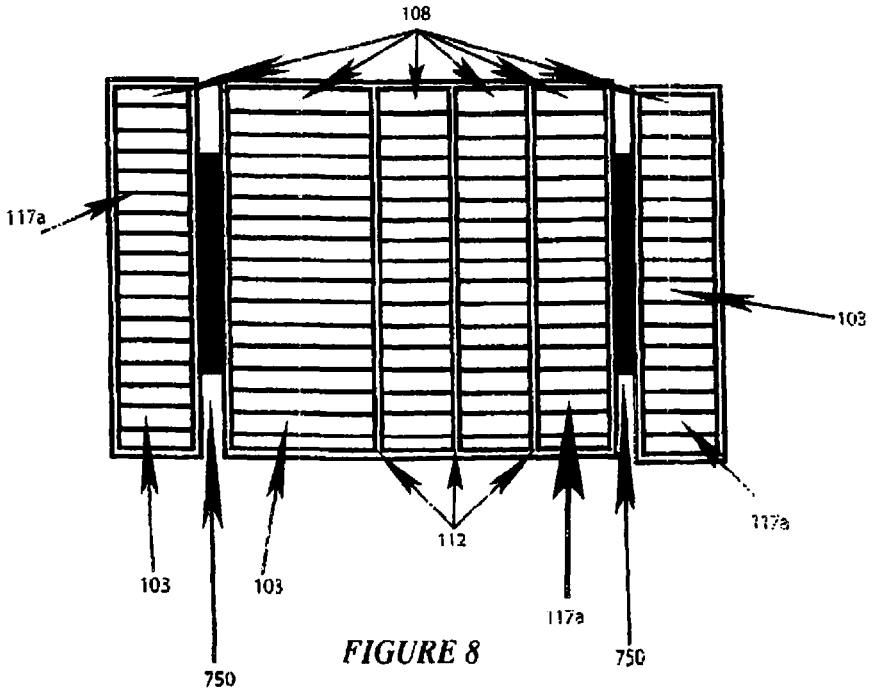
FIG. 8 illustrates the panel members.

FIG. 8 illustrates fitting panel sections 108, of panel 103, cut to fit between the brackets 750, and outside the brackets 750.

FIG. 8 shows the installed device members 103, outside wall bracket 750 and in between the wall brackets 750, panel sections 108, cut lines 112, front painted or laminated material 117*a* of the device member 103. The two outside panels 108 cut from another device member 103 to make a full installation using one complete device member and two single panel members cut from a second device member that are installed outside the two brackets without removing the radiator.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

With air condition ducting the device reduces convective heat transfer on all sides or circumference of ducting lifting and elevating the airflow away from the surface of the device creating a limit layer of stagnant air between the device and the forced airflow. The fans forcing airflow will be assisted by this action thereby saving energy. Radiative barriers and enclosed air spaces are a part of the device affecting the amount of heating or cooling needed to maintain desired temperatures and humidity in controlled air. Regardless of how well insulated and sealed a building is, buildings gain heat from warm air or sunlight or lose heat to cold air and by radiation. Engineers use a heat load calculation to determine the HVAC needs of the space being cooled or heated. The thermal insulation energy saver device benefits air condition ducting producing savings on fuel use and increased comfort level.

Factors in the design of a ducting thermal insulation device include the flow rate (which is a function of the fan speed and exhaust vent size) and noise level. If forced air in the ducting, has to traverse unheated space such as an attic, the ducting is insulated internally by a limit layer of stagnant air preventing condensation on the ducting.

The invention claimed is:

1. A heating system to heat an interior room, comprising:

a radiator member for generating heat;

a wall member being positioned in a space relationship to the radiator member;

a thermal insulation device member being positioned between the radiator member and the wall member;

a device member having a first air encapsulated sealed channel defined by a Z-shaped front panel and a Z-shaped center panel conforming in shape to the Z-shaped front panel and a second air encapsulated sealed channel being defined by the Z-shaped center panel and a vertical back panel being sealed within the device member that takes advantage of the natural properties of air to improve insulation, through vortices that create a layer of stagnant air which allows the radiator member to function by reducing heat transfer through the wall member behind and above the radiator member, and wherein the device member includes a stack of inclined tooth pitches allowing vortices to create a layer of stagnant air in front of the device member pushing an air stream away from the wall member, and wherein the device member allows the heating system to limit thermal exchange by radiation and convection with two differently configured channels, and wherein the device member includes two different horizontal surfaces and a vertical surface through the channels define a series of right triangular shapes, and wherein the device member includes a stacked profiled face to direct hot air stream towards the radiator member and into the room, and wherein the device member forms the layer of stagnant air in the first sealed channel and the second sealed channel, and wherein the device member includes a stack of inclined surfaces to form an insulating cushion of air in front of the device member to increase the air speed, and wherein the device member stops moisture expansion through the wall member, and wherein the device member reduces convective heat transfer due to the first sealed channel and the second sealed channel of the device member ensuring that the air in the room is heated increasing the efficiency of the heating system, and wherein the device member insulates the heated air from the wall member and exterior.

2. A heating system to heat an interior room according to claim 1, wherein the device member disperses heated air is into the room in a figure eight pattern, heating the space within in the room providing faster warm up time.

3. A heating system to heat an interior room according to claim 1, wherein the device member reduces night time set back by thermally insulating the radiator member from the wall member thereby minimizing the dynamic effects of heating and cooling of the building.

4. A heating system to heat an interior room, comprising:

a radiator member for generating heat;

a wall member being positioned in a space relationship to the radiator member;

a thermal insulation device member being positioned between the radiator member and the wall member;

a device member having a first air encapsulated sealed channel defined by a Z-shaped front panel and a Z-shaped center panel conforming in shape to the Z-shaped front panel and a second air encapsulated sealed channel being defined by the Z-shaped center panel and a vertical back panel being sealed within the device member that takes advantage of the natural properties of air to improve insulation, through vortices that create a layer of stagnant air which allows the radiator member to function by reducing heat transfer through the wall member behind and above the radiator member, and wherein the device member includes a stack of inclined tooth pitches allowing vortices to create a layer of stagnant air in front of the device member pushing an air stream away from the wall member, and wherein the device member allows the heating system to limit thermal exchange by radiation and convection with two differently configured channels, and wherein the device member includes two different horizontal surfaces and a vertical surface through the channels define a series of right triangular shapes, and wherein the device member includes a stacked profiled face to direct hot air stream towards the radiator member and into the room, and wherein the device member forms the layer of stagnant air in the first sealed channel and the second sealed channel, and wherein the device member includes a stack of inclined surfaces to form an insulating cushion of air in front of the device member to increase the air speed, and wherein the device member stops moisture expansion through the wall member, and wherein the device member reduces convective heat transfer due to the first sealed channel and the second sealed channel of the device member ensuring that the air in the room is heated increasing the efficiency of the heating system, and wherein the device member insulates the heated air from the wall member and exterior.

5. A heating system to heat an interior room according to claim 4, wherein the device member disperses heated air is into the room in a figure eight pattern, heating the space within in the room providing faster warm up time.

6. A heating system to heat an interior room according to claim 5, wherein the device member reduces night time set back by thermally insulating the radiator member from the wall member thereby minimizing the dynamic effects of heating and cooling of the building.

* * * * *